US009027596B2

(12) United States Patent
Ness et al.

(10) Patent No.: US 9,027,596 B2
(45) Date of Patent: May 12, 2015

(54) METHOD AND APPARATUS FOR HANDLING OIL AND GAS WELL DRILLING FLUIDS

(76) Inventors: Daniel W. Ness, Metairie, LA (US); Robert Bartlett, New Orleans, LA (US)

( * ) Notice: Subject to any disclaimer, the term of this patent is extended or adjusted under 35 U.S.C. 154(b) by 0 days.

(21) Appl. No.: 13/490,409

(22) Filed: Jun. 6, 2012

(65) Prior Publication Data

US 2013/0087217 A1 Apr. 11, 2013

Related U.S. Application Data

(60) Provisional application No. 61/494,211, filed on Jun. 7, 2011.

(51) Int. Cl.

| | |
|---|---|
| ***F17D 1/00*** | (2006.01) |
| ***F17D 1/08*** | (2006.01) |
| ***B65D 25/00*** | (2006.01) |
| ***E21B 21/01*** | (2006.01) |

(52) U.S. Cl.

CPC *F17D 1/08* (2013.01); *B65D 25/00* (2013.01); *E21B 21/01* (2013.01)

(58) Field of Classification Search

USPC ..... 137/574, 576, 571, 575, 376, 583, 584; 220/646–650

See application file for complete search history.

(56) References Cited

U.S. PATENT DOCUMENTS

| | | | | |
|---|---|---|---|---|
| 1,039,091 | A * | 9/1912 | Boyce et al. | 137/264 |
| 2,218,689 | A * | 10/1940 | Stewart | 114/78 |
| 2,281,057 | A * | 4/1942 | Phul, Jr. | 137/265 |
| 2,703,607 | A * | 3/1955 | Simmonds | 137/265 |
| 3,426,733 | A * | 2/1969 | Von Wiesenthal | 122/1 R |
| 4,251,005 | A * | 2/1981 | Sons et al. | 220/563 |
| 4,331,252 | A * | 5/1982 | Carren et al. | 220/4.17 |
| 4,491,076 | A * | 1/1985 | Forshee | 108/53.1 |
| 4,858,778 | A * | 8/1989 | Patrick | 220/562 |
| 5,292,012 | A * | 3/1994 | Davis et al. | 211/85.18 |
| 6,237,545 | B1 * | 5/2001 | Barnett et al. | 122/235.23 |
| 6,357,365 | B1 * | 3/2002 | Higgins et al. | 108/55.1 |
| 6,371,299 | B1 * | 4/2002 | Essary | 206/600 |
| 6,422,405 | B1 * | 7/2002 | Haenszel | 211/175 |
| 6,564,961 | B1 * | 5/2003 | Klein | 220/563 |
| 6,915,815 | B1 | 7/2005 | Ness | |
| 6,983,704 | B1 * | 1/2006 | Ness | 108/55.3 |

FOREIGN PATENT DOCUMENTS

| | | |
|---|---|---|
| RU | 2379577 | 1/2010 |
| SU | 979614 | 12/1982 |

* cited by examiner

*Primary Examiner* — John K Fristoe, Jr.
*Assistant Examiner* — Umashankar Venkatesan
(74) *Attorney, Agent, or Firm* — Garvey, Smith, Nehrbass & North, L.L.C.; Charles C. Garvey, Jr.; Vanessa M. D'Souza

(57) ABSTRACT

A fluids management apparatus is disclosed herein that enables management of multiple volumes of different fluids when drilling and/or producing oil and/or gas with an oil and gas well drilling platform. The apparatus includes a structural, transportable frame that has upper and lower reservoir sections, each with a plurality of tanks for holding fluid. The upper reservoir section is easily lifted and transported, such as by crane. A docking station on the lower reservoir section is receptive of the upper reservoir section. A piping system enables a selected fluid volume contained in a tank of the upper reservoir section to be selectively transmitted to a selected tank of the lower reservoir section. The lower reservoir section has its own piping system that enables a user to withdraw fluid from any selected one of its tanks.

26 Claims, 12 Drawing Sheets

METHOD AND APPARATUS FOR HANDLING OIL AND GAS WELL DRILLING FLUIDS

CROSS-REFERENCE TO RELATED APPLICATIONS

In the US, this is a non provisional patent application of U.S. Provisional Patent Application Ser. No. 61/494,211, filed 7 Jun. 2011.

Priority of U.S. Provisional Patent Application Ser. No. 61/494,211, filed 7 Jun. 2011, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the handling of oil and gas well drilling fluids, especially in an offshore or marine environment. More particularly, the present invention relates to an improved oil and gas well fluids transfer apparatus that features a first module carrying multiple supply reservoirs for holding different drilling or production fluids and a second, typically smaller supply module for holding one or more resupply modules.

2. General Background of the Invention

In the drilling of oil and gas wells, a large number of different fluids are typically employed. These fluids can include various chemicals or chemical formulas that assist in the drilling process. These fluids can include, for example, drilling mud, surfactants, brine solutions, thickening solutions, other oil well drilling or completions fluids and the like.

In a coastal or offshore marine environment, the drilling of oil and gas wells employs a platform that can be floating, semi-submersible, fixed, tension leg, spar or the like. Such coastal, offshore or marine oil platforms are well known in the art.

An offshore marine platform typically suffers from lack of space. These spacial constraints are due to the enormous expense of constructing offshore drilling platforms. A huge array of equipment is needed for the drilling and completion of oil and gas wells. Constant supply and resupply is an ongoing procedure. Huge work boats carry drill pipe, equipment, personnel, food, drilling fluids, completion fluids, and other material to the offshore platform. Unloading and placement of these supplies is an enormous problem.

In the handling of fluids, huge volumes can be required. After the fluids are expended, the tank or other vessel that carried the fluid must quickly be moved from the rig floor to make room for the others.

Over the years, 55 gallon drums and other like disposable containers have been used to transfer drilling and other fluids to and from an oil and gas well drilling rig. These drums and like containers create a huge storage problem for the drilling rig operators.

BRIEF SUMMARY OF THE INVENTION

The present invention provides an improved fluids transfer system that enables a rig operator to efficiently and quickly transfer fluids during normal course of operation of the offshore platform.

The present invention provides an efficient and novel and improved system, including a method and apparatus for transferring drilling fluids to an offshore oil and gas well drilling platform and for fluid transfer once on the platform.

The present invention provides an improved fluids transfer system having improved structural integrity that enables transport on marine vessels and lifting with cranes and the like while maintaining fluid holding tanks so that leakage is not a problem.

The present invention includes a fluids management apparatus for managing multiple, different fluids on an oil and gas well drilling platform, comprising a structural, transportable frame that has upper and lower end portions, a plurality of side walls, a plurality of corners, a base, and an upper panel; a reservoir section on the frame having a plurality of storage reservoirs for holding multiple, separate fluids, one separate fluid in each reservoir; a plurality of flow outlets for discharging a selected fluid from a selected reservoir; a docking station on the frame above the reservoir section, each station configured to receive a tank having a fluid holding interior that connects to a reservoir; piping that enables a selected of the storage reservoirs to transfer its contents to a selected of the storage reservoirs; each wall having vertical and horizontal stiffners, each vertical stiffner having a web, each horizontal stiffner connecting to a said vertical stiffner web; each storage reservoir having a side that is a part of a said side wall, a plurality of transverse sides, and an internal longitudinal wall; a reservoir stiffner panel that extends a partial distance across a said storage reservoir; and a plurality of lifting eyes attached to the frame, at least a pair of said horizontal stiffners attaching to each said lifting eye.

Preferably, each reservoir stiffner attaches to a transverse wall.

Preferably, there are between 4 and 6 storage reservoirs.

Preferably, at least one of the storage reservoirs is smaller than another of the storage reservoirs.

Preferably, one of the storage reservoirs extends from one side wall to another side wall.

Preferably, the frame has multiple lifting eyes that attach to a side wall and said upper panel.

Preferably, each lifting eye is connected to a horizontal stiffner.

Preferably, each lifting eye is in the form of a plate that forms an acute angle with a side wall.

Preferably, each lifting eye is spaced in between a corner and another lifting eye.

Preferably, each tank support is mounted upon a said vertical stiffner.

Preferably, the present invention further comprises a plate on the upper end portion of each vertical stiffner, said plate forming a load transfer location for a said tank.

The present invention includes a fluids management apparatus for managing multiple, different fluids in an oil and gas well drilling platform, comprising a structural, transportable frame; a lower tank section on the frame having a plurality of interval storage tanks for holding multiple, separate fluids, said interval storage tanks surrounded by external side walls and end walls; a plurality of flow outlets for discharging a selected fluid from a selected interval storage tank; an upper tank section that comprises one or more transportable, crane liftable tanks; a docking station on the frame above the lower tank section that is configured to receive the upper tank section, the upper tank section having a plurality of supply tanks; piping that enables a selected of the supply tanks to transfer its contents to a selected of the interval storage tanks; a plurality of horizontal and a plurality of vertical stiffners on said lower tank section, the horizontal and vertical stiffners intersecting;

the docking station including load transfer plates on said vertical stiffners that define supports for receipt of the docking station; each vertical stiffner having a web attached to a wall and a flange attached to a said web; and each load transfer plate at the top of each vertical stiffner, said load transfer plate attached to both said web and said flange.

Preferably, there are at least three interval storage tanks.

Preferably, there are between 4 and 6 interval storage tanks.

Preferably, at least one of the supply tanks is smaller than one of the interval storage tanks.

Preferably, all of the supply tanks are smaller than each interval storage tank.

Preferably, all of the flow outlets are positioned on the same side of the frame.

Preferably, all of the flow outlets are positioned side-by-side and next to each other.

Preferably, each supply tank has a supply tank outlet and the piping includes a plurality of flow lines, each connectable to a supply tank outlet.

Preferably, each interval storage tank has a flow inlet and the piping includes multiple flow lines that enable flow to be directed to a selected interval storage tank from a selected supply tank.

The present invention includes a fluids management apparatus for managing multiple, different fluids in an oil and gas well drilling platform, comprising: a structural, transportable frame having side walls, end walls, a bottom wall and an upper panel; a lower reservoir section on the frame having a plurality of interval storage reservoirs for holding multiple, separate fluids; a plurality of flow outlets for discharging a selected fluid from a selected interval storage reservoir; a docking station on the frame above the lower reservoir section, said docking station configured to receive one or more fluid holding vessels; and a reinforcement system for multiple of said walls that includes intersecting pluralities of horizontal and vertical stiffners, each said vertical stiffner having an upper fitting that provides an attachment for and load transfer from a said fluid holding vessel.

Preferably, each vertical stiffner has a web and a flange that is connected to the web and wherein each fitting is attached to both a web and a flange.

Preferably, the present invention further comprises an upper frame that holds multiple of said fluid holding vessels.

Preferably, said upper frame has legs, each leg resting upon a said fitting.

Preferably, the upper frame has one or more doors that can be opened and closed.

Preferably, one of the storage reservoirs is a larger reservoir that extends to opposing sides of the interval longitudinal wall and further comprising an opening in the interval longitudinal wall that is in communication with the larger reservoir.

Preferably, the upper frame has multiple upper angled plates that each form an obtuse angle with the bottom of a fluid holding vessel.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
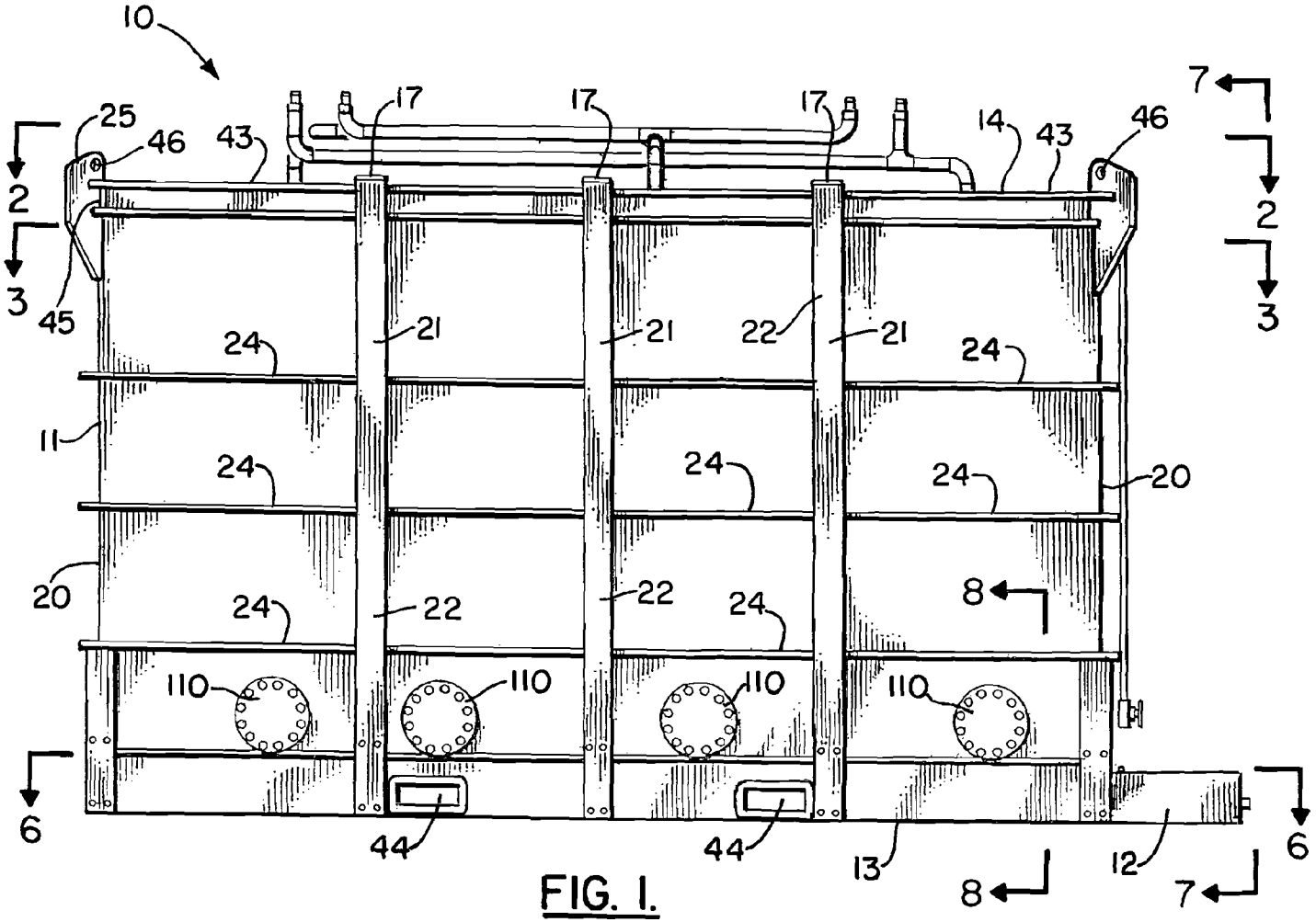
FIG. 1 is a partial elevation view of a preferred embodiment of the apparatus of the present invention.

FIGS. 1-13 show generally a preferred embodiment of the apparatus of the present invention, designated generally by the numeral 10 in FIGS. 1-10. The apparatus of the present invention can be made of welded metal. Fluids management apparatus 10 provides a storage reservoir 11 having a base 12. The storage reservoir 11 has an upper end portion 14 and a lower end portion 13. The upper end portion 14 provides an upper panel 15. The upper panel 15 has a plurality of openings 18, each being closeable using a manway cover 16.

Figure 2:
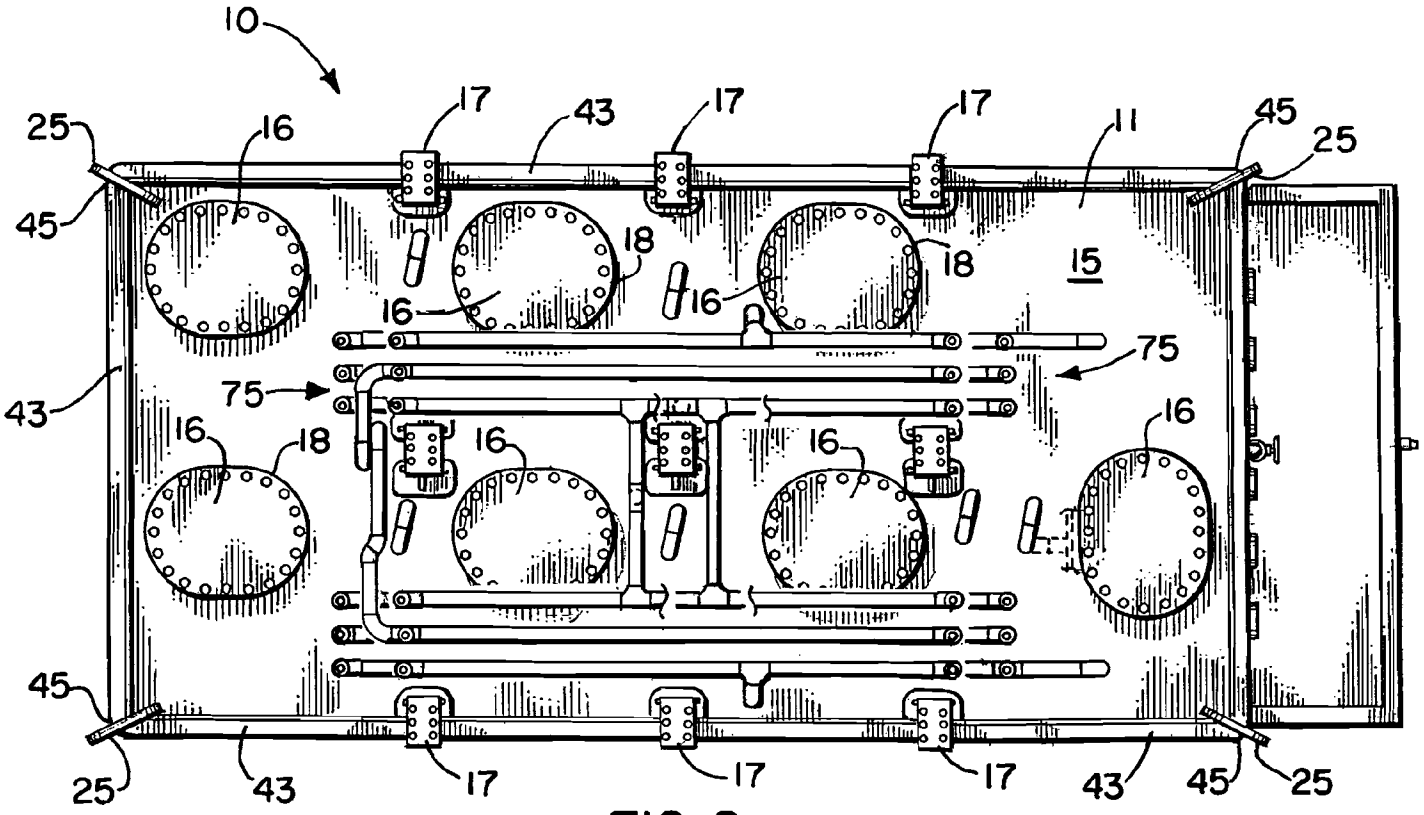
FIG. 2 is a partial plan view of a preferred embodiment of the apparatus of the present invention, taken along lines 2-2 of FIG. 1.
Figure 3:
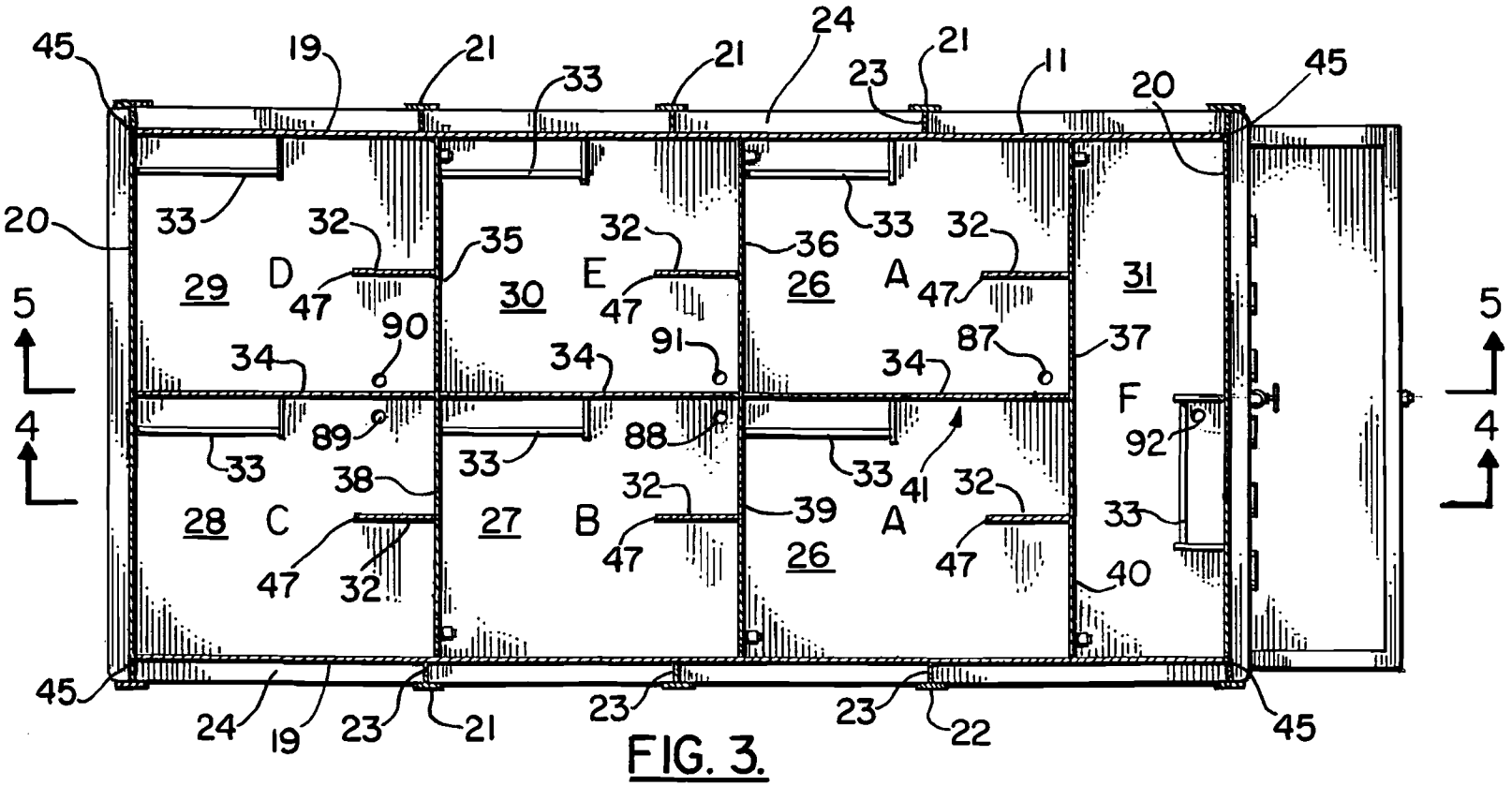
FIG. 3 is sectional view of a preferred embodiment of the apparatus of the present invention, taken along lines 3-3 of FIG. 1.
Figure 7:
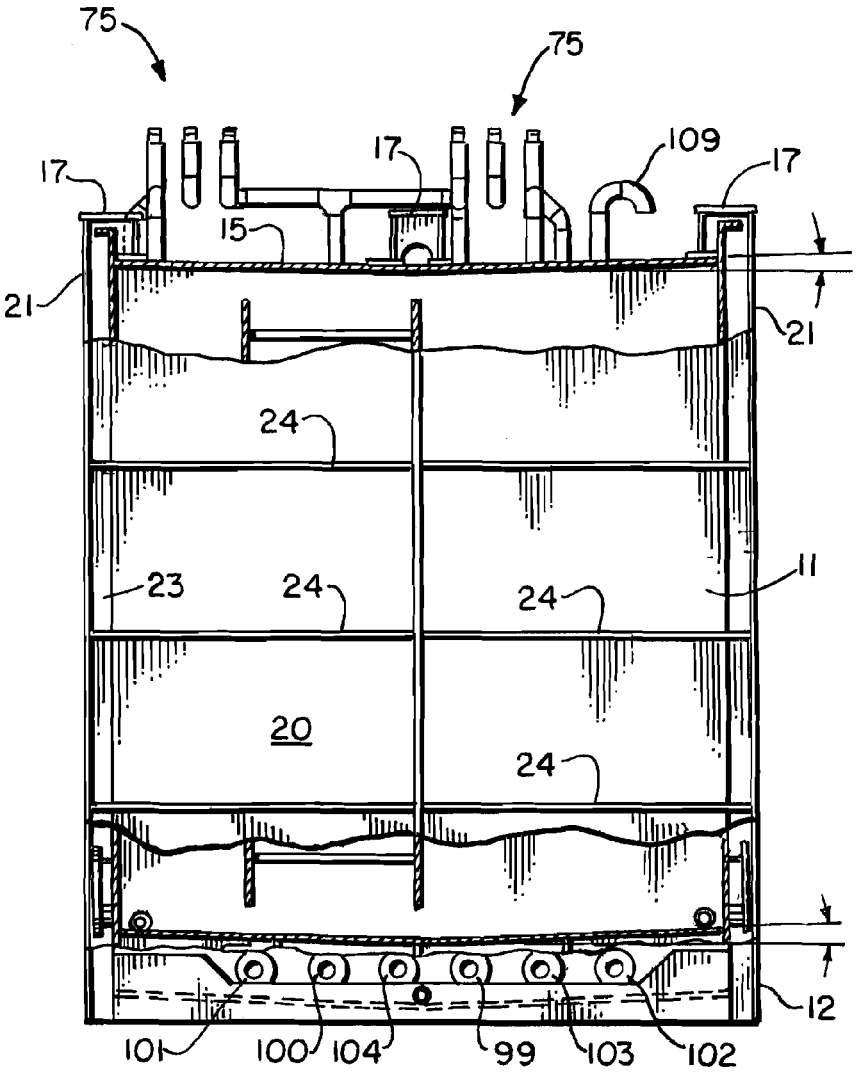
FIG. 7 is an end view taken along lines 7-7 of FIG. 1.

A plurality of tank support plates 17 are shown in FIGS. 1 and 2. The plurality of support plates 17 connect to and transfer load from a docking station or platform 42 which is shown in more detail in FIGS. 10-13. Storage reservoir 11 has a number of internal tanks, such as the six internal tanks that are designated by the numerals 26, 27, 28, 29, 30, 31 in FIG. 3. These internal tanks or internal reservoirs 26-31 are surrounded by outer side walls 19, end walls 20 and internal walls 34-40 as seen in FIG. 3. Each internal tank/reservoir can be provided with a ladder 33. Each of the side walls 19 is reinforced with vertical supports 21 and horizontal supports 24. The upper most flange of horizontal supports 24 is a rim flange 43. Each vertical support 21 includes a flange 22 that is connected to a web 23. Each of the support plates 17 is attached to the upper end portion or top of a vertical support 21 as shown in FIGS. 1 and 7. The web of each vertical support 21 can be connected (for example welded) to a side wall 19. In FIG. 3, there are three vertical supports 21 attached to one side wall 19 and three additional vertical supports 21 attached to the opposing or other side wall 19 as shown.

Figure 6:
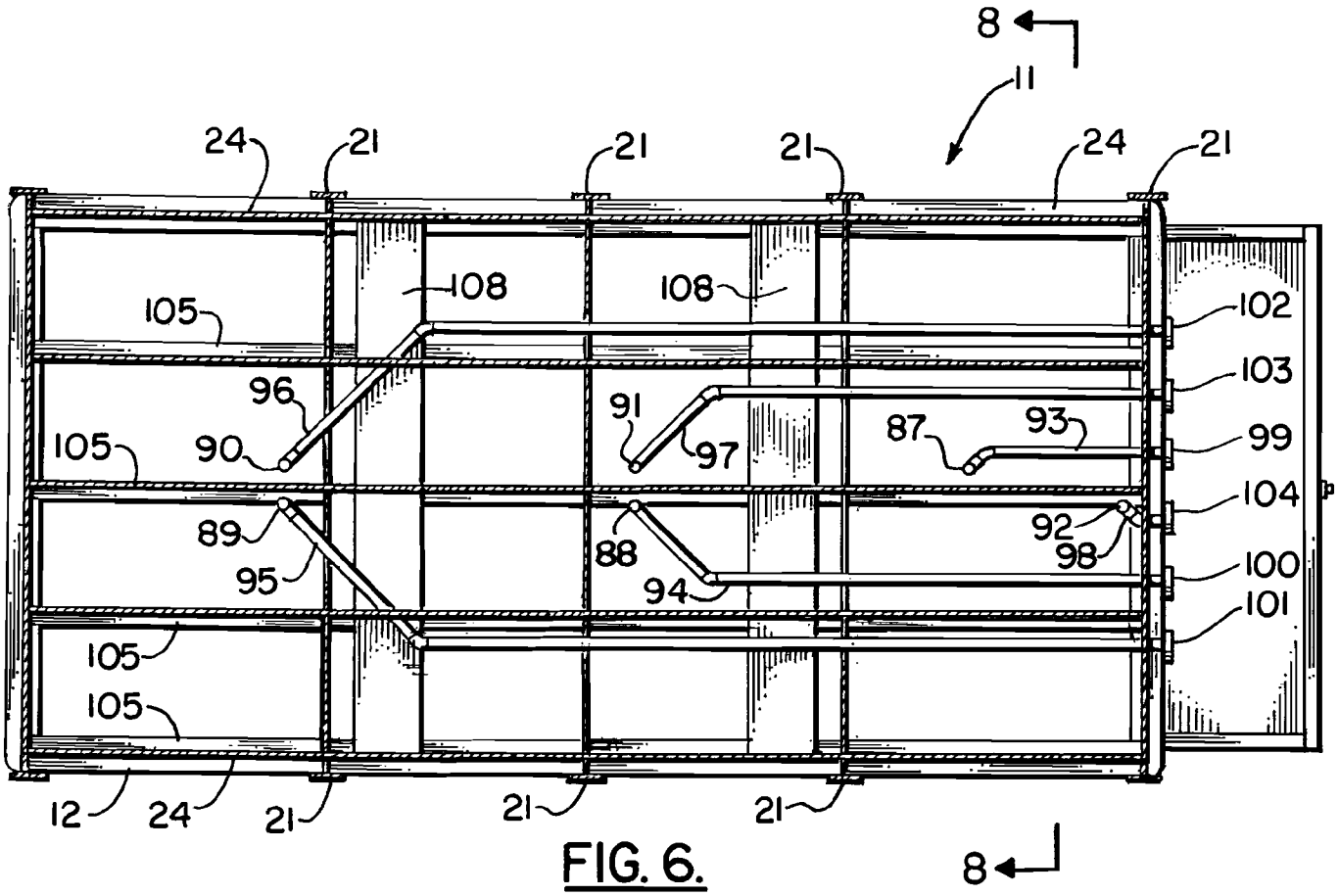
FIG. 6 is a sectional view taken along lines 6-6 of FIG. 1.

A plurality of horizontal stiffners 24 can be seen in FIG. 1, connected to each side wall 19 and end wall 20 (e.g. welded connection). Each horizontal stiffner 24 extends to a corner 45 of storage reservoir 11 as shown in FIGS. 2, 3, 6. Each horizontal stiffner connects to both flange 22 and web 23 of a vertical support 21 (e.g. a welded connection).

A plurality of lifting eyes 25 are provided, one lifting eye position at upper end portion 14 of storage reservoir 11 and next to a corner 45 as shown in FIGS. 1-2 and 4-5. Each lifting eye 25 provides an opening 46 for attaching rigging such as a sling, shackle, hook or the like to the lifting eye 25 so that the entire apparatus 10 can be lifted with a crane or other lifting device.

Figure 4:
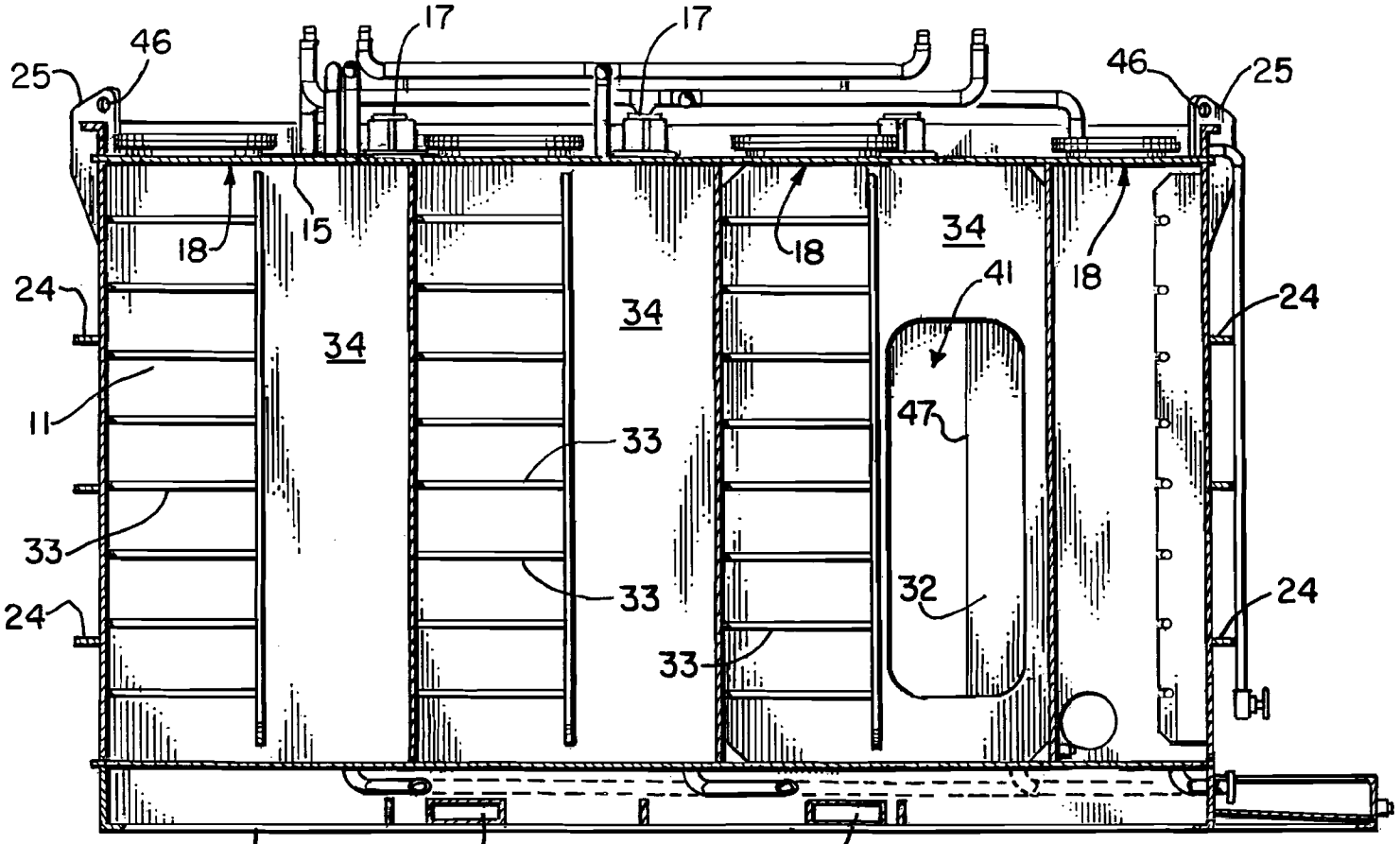
FIG. 4 is a sectional view taken along lines 4-4 of FIG. 3.
Figure 5:
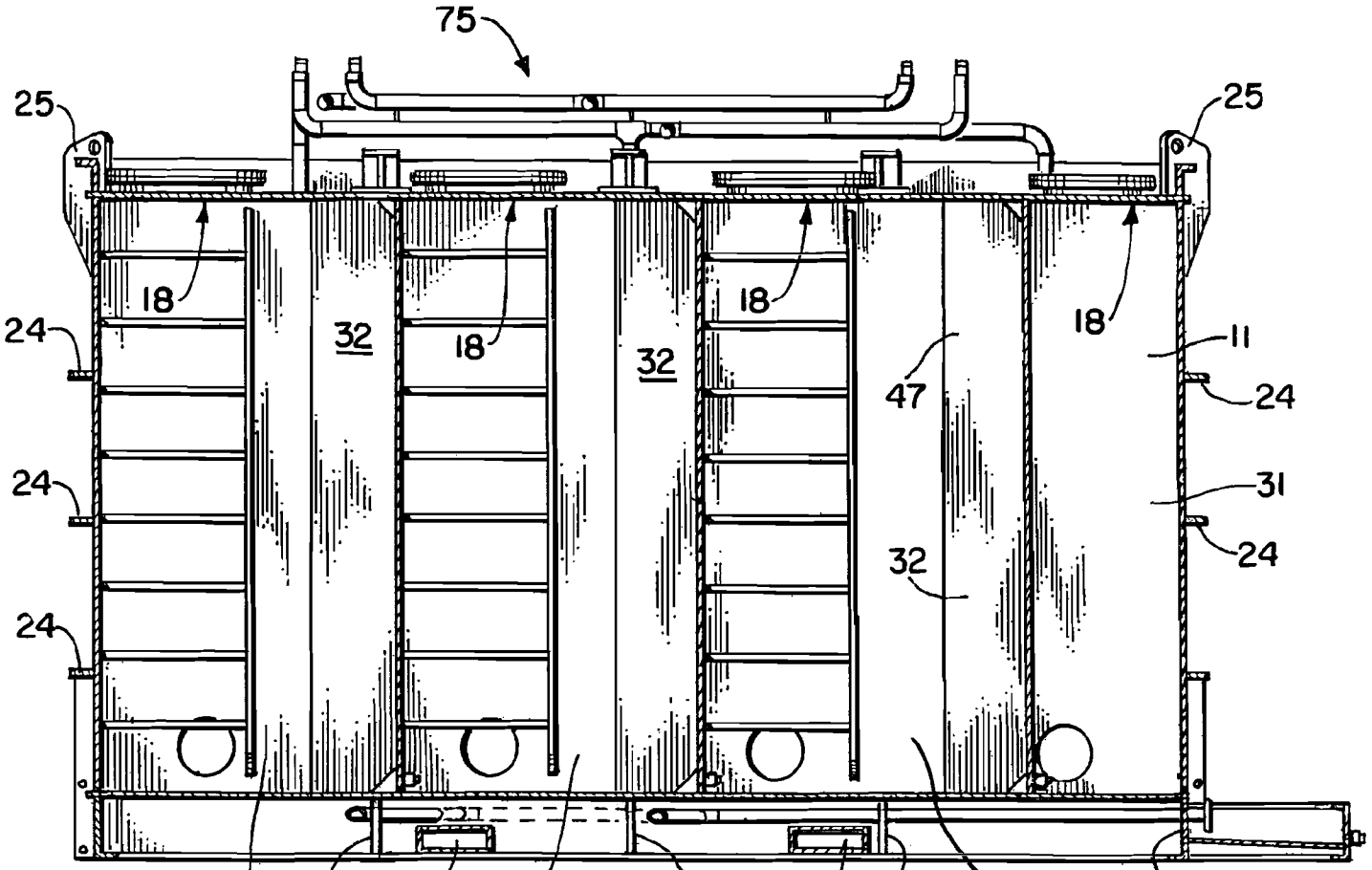
FIG. 5 is a sectional view taken along lines 5-5 of FIG. 3.

FIG. 3 shows the individual internal tanks or reservoirs 26-31 which are separated with internal walls including a longitudinal wall (or walls) 34 and a plurality of transverse walls 35-40. Wall 34 (or a wall 34) is structurally connected (e.g. welded) to end wall 20 (see FIG. 3). The transverse walls 36, 39 and 37, 40 surround a single tank 26 which extends completely across the storage reservoir 11 from one side wall 19 to the other side wall 19 as shown in FIGS. 3 and 4. Opening 41 (see FIG. 4) and longitudinal wall 34 enables fluid to flow freely in tank 26 from one side of longitudinal wall 34 to the other side of wall 34.

A plurality of internal support plates 32 are shown, at least one for each internal tank or reservoir 26-30. The internal tank 26 has two of these vertical plates or support plates 32. Each support plate 32 extends a partial distance across an internal tank 26, 27, 28, 29, 30, beginning at a transverse wall 35-40 as shown in FIG. 3 and terminating at a free edge or end 47 before reaching another transverse wall.

Figure 9:
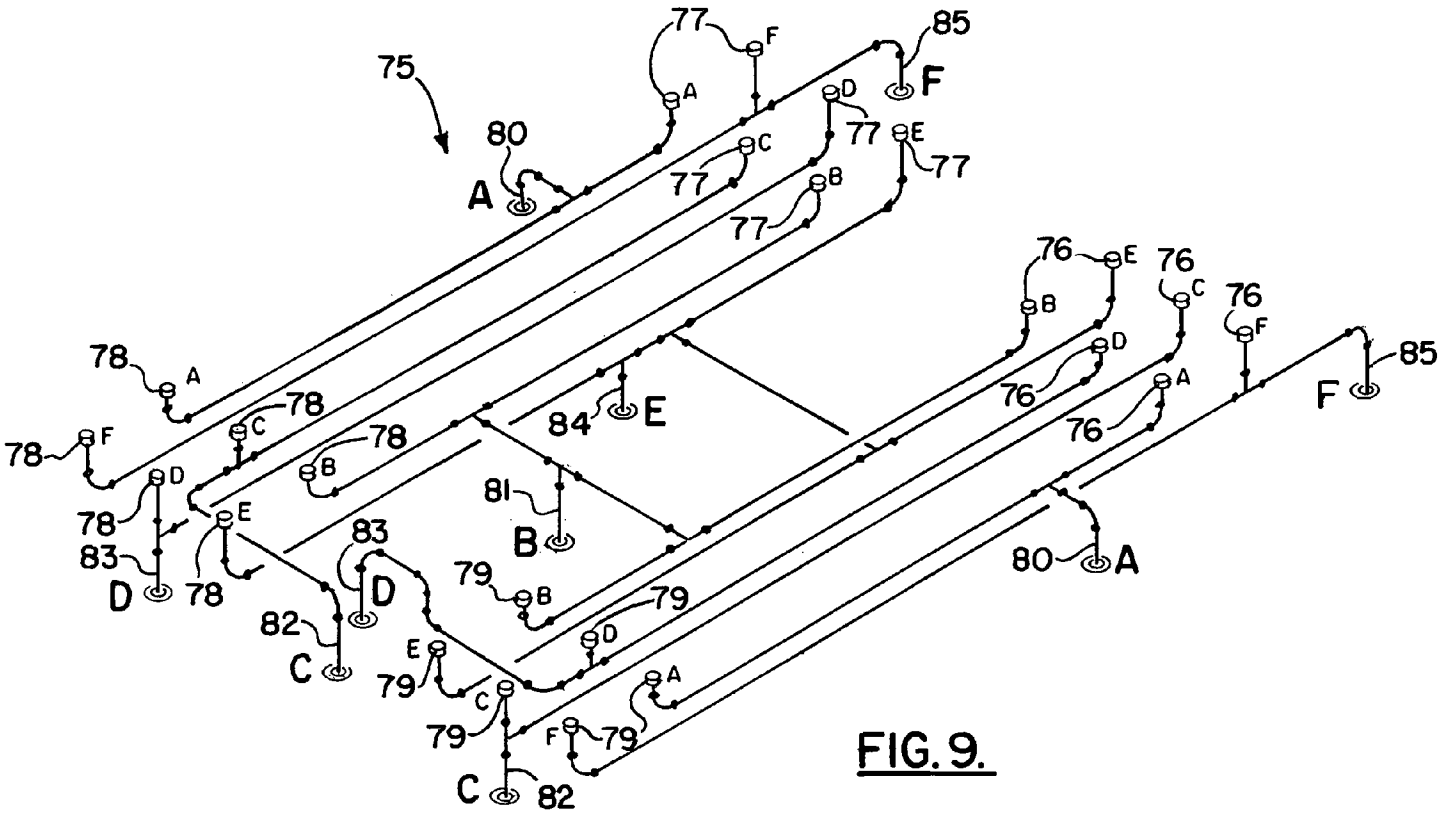
FIG. 9 is a schematic partial perspective view of a preferred embodiment of the apparatus of the present invention illustrating the piping.
Figure 10:
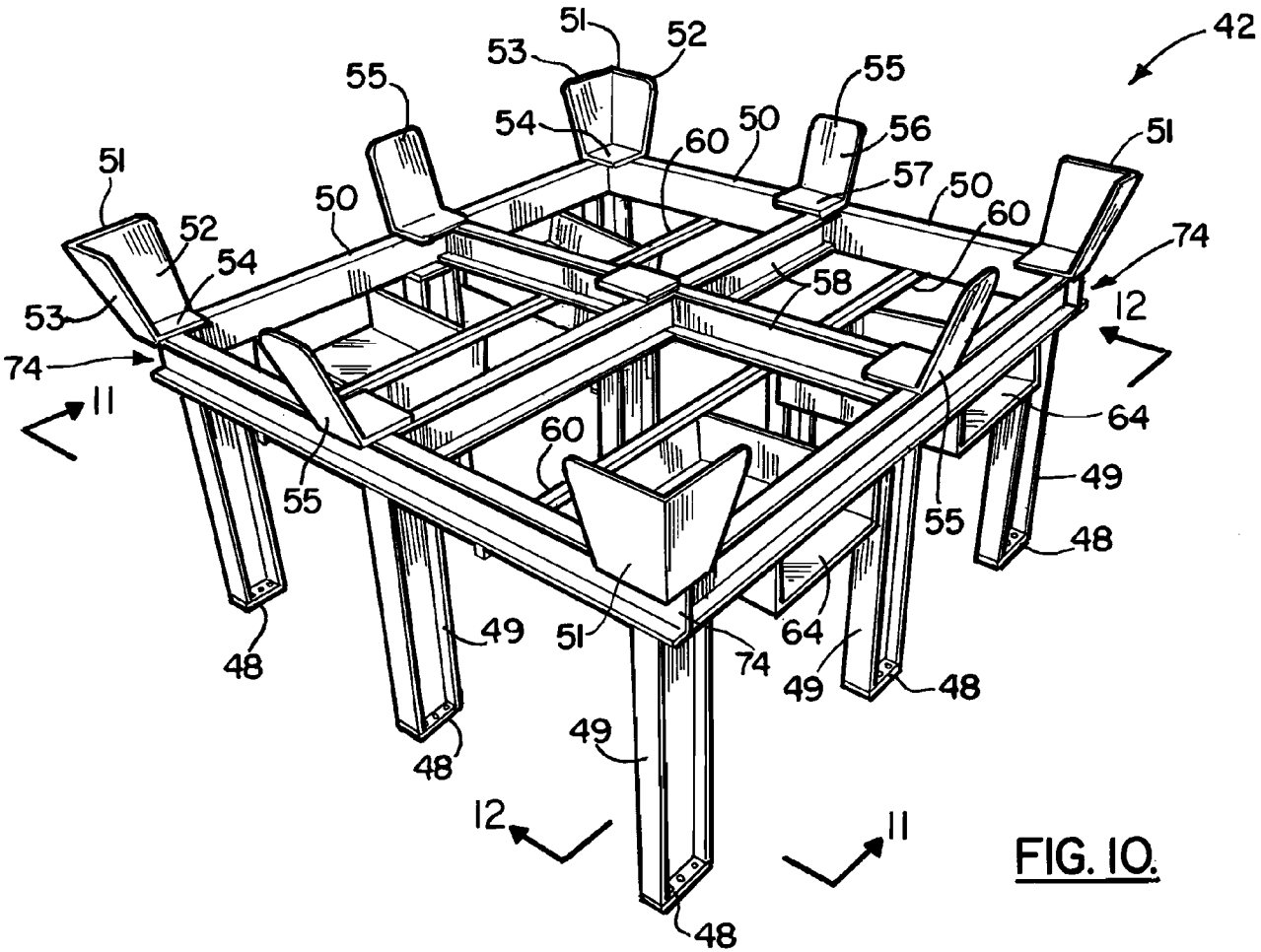
FIG. 10 is a fragmentary perspective view of a preferred embodiment of the apparatus of the present invention illustrating the docking station.
Figure 13:
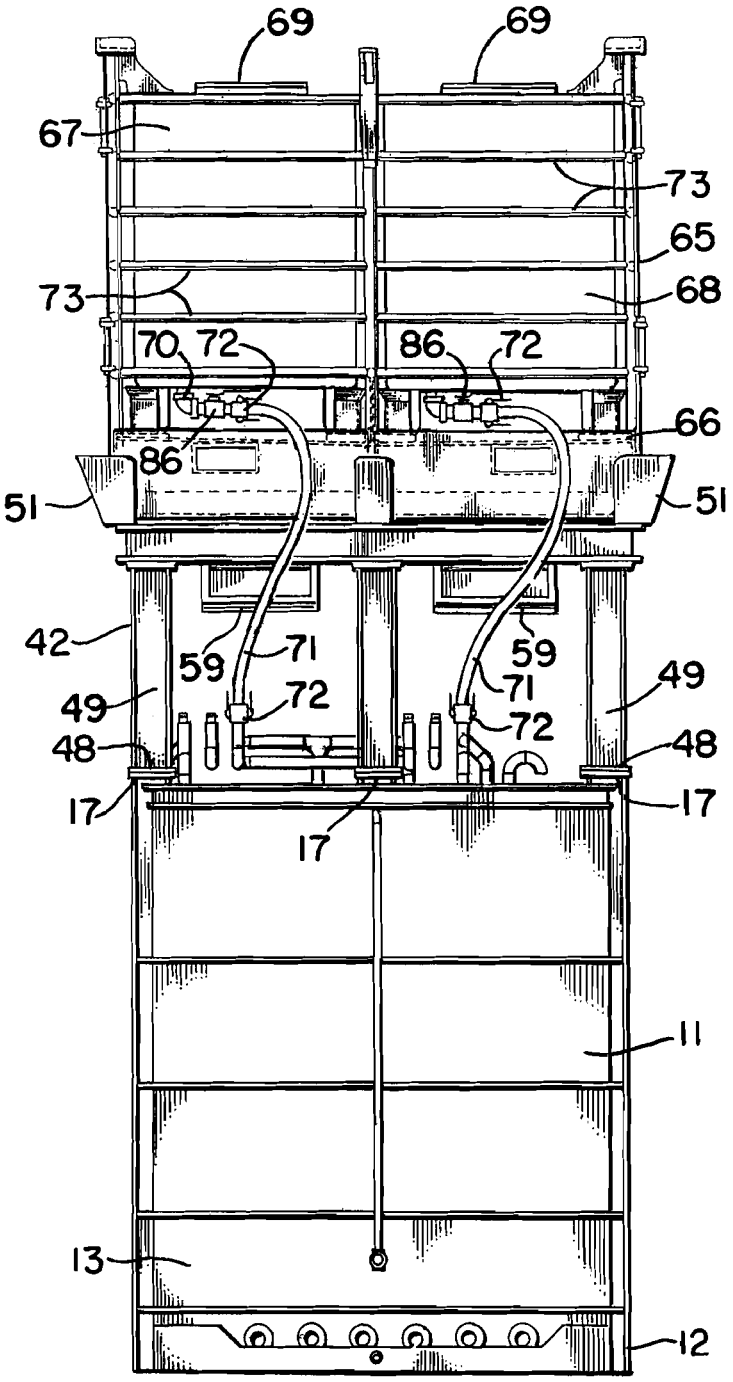
FIG. 13 is an elevation view of a preferred embodiment of the apparatus of the present invention.

In connection with the piping system 75 of FIG. 9, each reservoir or tank 26-31 is able to receive fluid from any selected tank 67, 68 of rack 65 that can be placed above storage reservoir 11 by using docking station 42 (see FIGS. 10, 13). In FIG. 9, letters A, B, C, D, E, F are used to designate fittings that transfer fluid from a particular tank 67 or 68 to a selected reservoir 26, 27, 28, 29, 30, 31. The letter A in FIG. 9 is associated with reservoir 26. The letter B in FIG. 9 is associated with the reservoir 27. The letter C in FIG. 9 is associated with the reservoir 28. In FIG. 9, the letters D, E, F are associated with reservoirs 29, 30, 31 respectively. Thus, a coupling 72 and hose 71 for tank 67 is shown attaching to a pipe inlet fitting 76 in FIG. 9 having letter designation "E" meaning that flow from tank 67 is being routed to reservoir 30.

Figure 11:
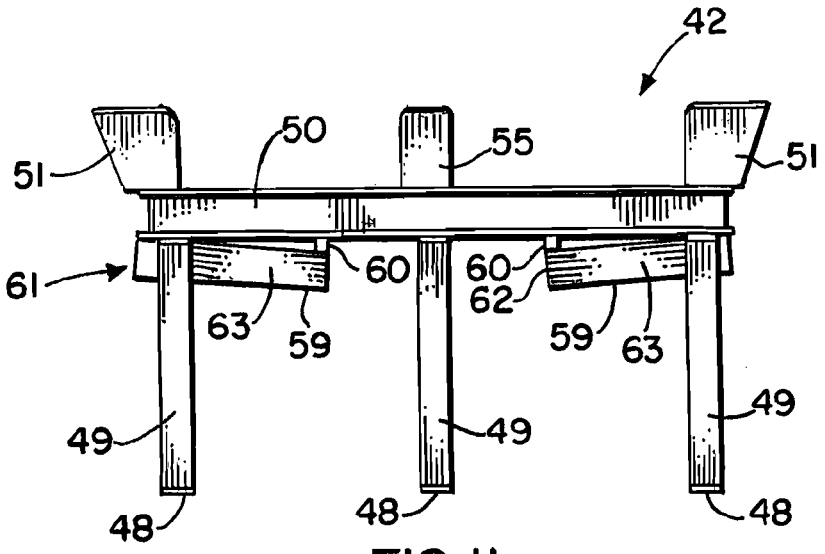
FIG. 11 is a fragmentary elevation view of a preferred embodiment of the apparatus of the present invention taken along lines 11-11 of FIG. 10, illustrating the docking station.
Figure 12:
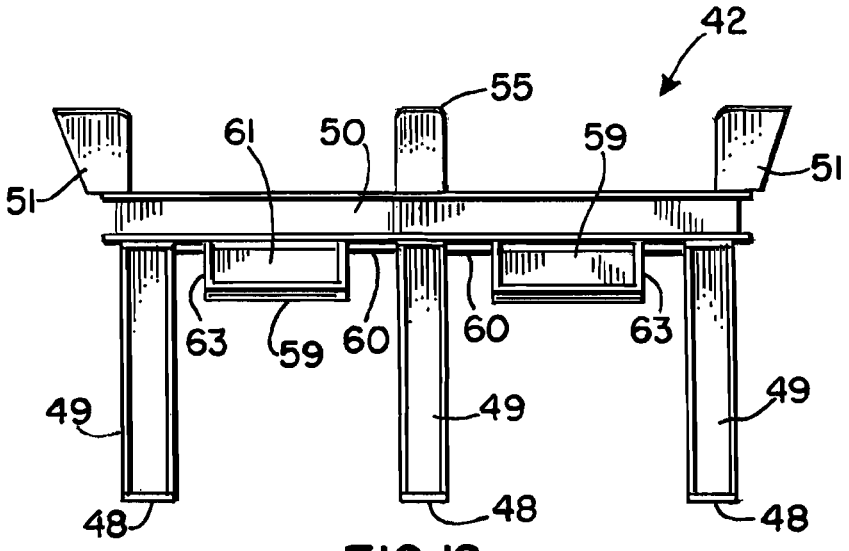
FIG. 12 is fragmentary elevation view of a preferred embodiment of the apparatus of the present invention taken along lines 12-12 of FIG. 10, illustrating the docking station.

Docking station or platform 42 can been seen in FIGS. 10-13. The docking station 42 provides a plurality of a feet 48, each connected to the lower end portion of a leg 49. Each of the legs 49 extends upwardly and forms a structural connection to both a perimeter member or beam 50 (which is generally horizontally extending) and a transverse beam or member 58 as shown in FIGS. 10-12. A plurality of fittings 51, 55 are attached to the beams 50 or 50, 58 as shown in FIGS. 10-12. These fittings include corner fitting 51 and intermediate fitting 55. Each corner fitting 51 includes an inclined plate or ramp 52, another inclined plate or ramp 53, and a horizontal plate or pad 54. These three plates or pads 52, 53, 54 can be structurally connected together (e.g. welding). Each corner fitting 51 is attached (e.g. welded) to the combination of two beams 50 at a corner 74 of docking station 42 as shown in FIGS. 10-12.

Intermediate fitting 55 includes two plates or pads including an inclined plate or pad or ramp 56 and a horizontal plate or pad 57. Each intermediate fitting 55 attaches (e.g. welding) to a horizontal member or beam 50 at its intersection with a transverse beam 58 as shown.

Multiple catch basins 59 are provided which can be welded to a perimeter horizontal member or beam 50 and a basin support beam 60. Each catch basin 59 includes side walls 63, bottom wall 64, and an end wall or closed end member 62. Each catch basin 59 has an open end 61 as shown. A bottom wall 64 is inclined toward closed end or end wall 62 as seen in FIGS. 10-12. A plurality of catch basins 59 are provided, one for each tank or vessel 67 or 68 that is contained in a transportable rack 65. The rack 65 can be seen in co-pending U.S. patent application Ser. No. 13/312,547, filed 6 Dec. 2011, which is incorporated herein by reference. Another example of a rack that contains or can contain multiple tanks or vessels can be seen in prior U.S. Pat. Nos. 6,983,704 and 7,552,687, each of which is incorporated herein by reference. Rack 65 provides a base 66 and side walls 73. Some of the side walls 73 can be in the form of gates that can be opened or closed for adding or removing a selected tank or vessel 67, 68 from the rack 65.

Each tank or vessel 67, 68 has an upper closure panel or plate 69 and a valved outlet 70 that can have a quick connect coupling 72 for attachment to a hose 71 or other conduit. A piping system 75 is provided which has quick connect couplings 72 for connecting to hose 71. Hose 71 can connect to a selected pipe inlet fitting 76, 77, 78, 79.

The apparatus 10 of the present invention thus enables the liquid contained in any selected tank 67 or 68 on rack 65 to be transmitted via the piping system 75 to any selected one of the internal tanks or reservoirs 26-31.

FIGS. 6-9 show the piping system 75 in more detail, further illustrating the ability to transfer fluid from a selected tank 67 or 68 contained within rack 65 to a selected internal tank or reservoir 26-31. In FIG. 9, there are four (4) pluralities of pipe inlet fittings 76, 77, 78, 79 which are provided for transferring fluid from any tank via a pipe inlet fitting. In FIG. 9 there are four sets of pipe inlet fittings 76, 77, 78, 79 because each set is with each tank 67, 68. Each of these fittings (such as fittings 76) provide a separate inlet fitting for sending fluid from a selected tank 67 or 68 to a selected reservoir or internal tank 26-31. There are letter designations A, B, C, D, E, F for each of the plurality of inlet fittings 76, 77,78,79 (as shown in FIG. 9). These designate a particular reservoir or internal tank 26-31. For example, in FIG. 13, the flow line 71 is shown attached to quick connect fitting 72 on tank 67. Another quick connect fitting 72 is provided on the selected inlet fitting 76. In FIG. 13 for example, the pipe inlet fitting 76 is designated by the letter "E" which is associated with the internal tank or reservoir 30. A control valve 86 can thus be opened in FIG. 13 to discharge the contents of tank 67 via flow line 71 to the pipe inlet fitting 76 having the letter designation E for emptying the contents of tank 67 into the reservoir 30. Because each tank 67 or 68 is able to connect to any one of four different inlet fittings 76, 77,78, or 79, any tank 67 or 68 can direct flow to any selected internal reservoir 26, 27, 28, 29, 30 or 31.

In FIG. 9, there can be seen risers 80-85. Each riser 80-85 is in fluid communication with a selected reservoir 26-31. The riser 80 communicates with the reservoir 26. The riser 81 communicates with the reservoir 27. The riser 82 communicates with the reservoir 28. The riser 83 communicates with the reservoir 29. The riser 84 communicates with the reservoir 30. The riser 85 communicates with the reservoir 31.

In order to discharge the contents of any selected one of the internal tanks or reservoirs 26-31, flow outlets or drains 87-92 are provided, one for each internal tank or reservoir 26-31 as shown in FIGS. 3 and 6. Each of these flow outlets or drains 87-92 is part of a flow line 93-98. For example, in FIGS. 3 and 6, the flow outlet or drain 87 is part of the flow line 93.

Each of the flow lines 93-98 communicates with an outlet flange or fitting 99-104. For example, in FIGS. 6 and 8, the flow line 93 is associated with the outlet flange 99. In this fashion, any one of the reservoirs or internal tanks 26-31 can be emptied via a flow line 93-98 to a selected outlet flange or fitting 99-104.

Figure 8:
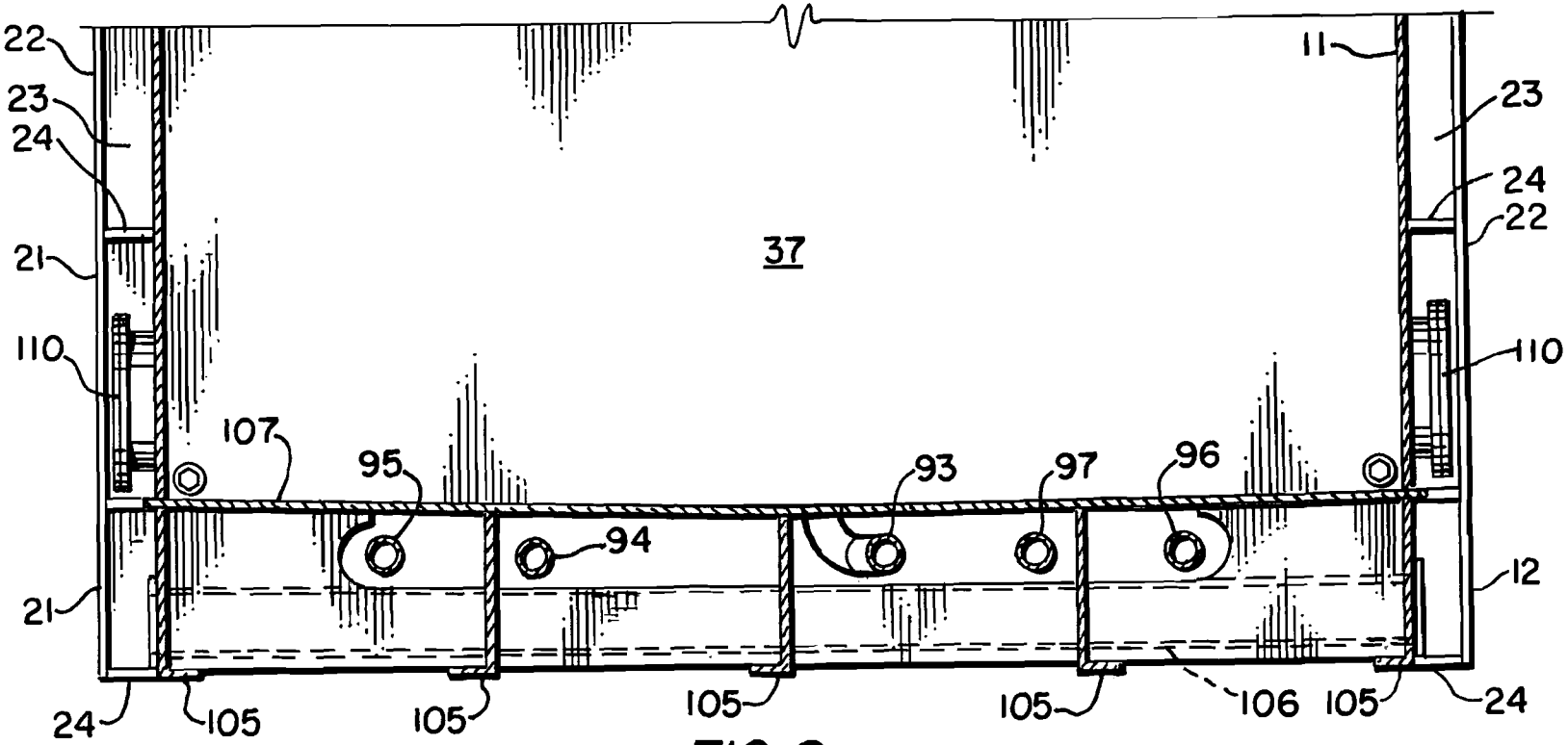
FIG. 8 is a sectional view taken along lines 8-8 of FIG. 6.

Base 12 is shown in more detail in FIGS. 6 and 8 as including longitudinal beams 105, and transverse beams 106. Each of the beams 105, 106 supports the reservoir floor 107. Fork lift channels 108 can be seen in FIG. 6 extending from one side to the other side of the base 12. Each of the channels

108 provides a socket 44 as shown in FIG. 4 that is receptive of the tines of a fork lift when it is necessary to transport the storage reservoir 11 using a fork lift. Each of the internal reservoirs 26-31 can be vented using a vent 109 in upper panel 15. Each internal reservoir 26-31 can be provided with an access opening or manway 110 in a side wall 19 or end wall 20.

The following is a list of suitable parts and materials for the various elements of the preferred embodiment of the present invention.

PARTS LIST

| Parts Number | Description |
|---|---|
| 10 | fluids management apparatus |
| 11 | storage reservoir |
| 12 | base |
| 13 | lower end portion |
| 14 | upper end portion |
| 15 | upper panel |
| 16 | manway cover |
| 17 | tank support plate |
| 18 | opening/manway |
| 19 | side wall |
| 20 | end wall |
| 21 | vertical support |
| 22 | flange |
| 23 | web |
| 24 | horizontal stiffner flange |
| 25 | lifting eye |
| 26 | internal tank/reservoir (tank A) |
| 27 | internal tank/reservoir (tank B) |
| 28 | internal tank/reservoir (tank C) |
| 29 | internal tank/reservoir (tank D) |
| 30 | internal tank/reservoir (tank E) |
| 31 | internal tank/reservoir (tank F) |
| 32 | vertical plate/support plate |
| 33 | ladder |
| 34 | longitudinal wall |
| 35 | transverse wall |
| 36 | transverse wall |
| 37 | transverse wall |
| 38 | transverse wall |
| 39 | transverse wall |
| 40 | transverse wall |
| 41 | opening |
| 42 | docking station/platform |
| 43 | rim flange |
| 44 | fork tube opening/channel/socket |
| 45 | corner |
| 46 | opening |
| 47 | free end/free edge |
| 48 | foot |
| 49 | leg |
| 50 | horizontal member/beam |
| 51 | corner fitting |
| 52 | inclined plate/ramp |
| 53 | inclined plate/ramp |
| 54 | horizontal plate/pad |
| 55 | intermediate fitting |
| 56 | inclined plate/ramp |
| 57 | horizontal plate/pad |
| 58 | transverse beam |
| 59 | catch basin |
| 60 | basin support beam |
| 61 | open end |
| 62 | closed end/end wall |
| 63 | side wall |
| 64 | bottom wall |
| 65 | rack |
| 66 | base |
| 67 | tank/vessel |
| 68 | tank/vessel |
| 69 | closure |
| 70 | valved outlet |
| 71 | hose |
| 72 | quick connect coupling |

-continued

PARTS LIST

| Parts Number | Description |
|---|---|
| 73 | side wall |
| 74 | corner |
| 75 | piping system |
| 76 | pipe inlet fitting |
| 77 | pipe inlet fitting |
| 78 | pipe inlet fitting |
| 79 | pipe inlet fitting |
| 80 | riser (to reservoir 26) |
| 81 | riser (to reservoir 27) |
| 82 | riser (to reservoir 28) |
| 83 | riser (to reservoir 29) |
| 84 | riser (to reservoir 30) |
| 85 | riser (to reservoir 31) |
| 86 | control valve |
| 87 | flow outlet/drain |
| 88 | flow outlet/drain |
| 89 | flow outlet/drain |
| 90 | flow outlet/drain |
| 91 | flow outlet/drain |
| 92 | flow outlet/drain |
| 93 | flow line |
| 94 | flow line |
| 95 | flow line |
| 96 | flow line |
| 97 | flow line |
| 98 | flow line |
| 99 | outlet flange/fitting |
| 100 | outlet flange/fitting |
| 101 | outlet flange/fitting |
| 102 | outlet flange/fitting |
| 103 | outlet flange/fitting |
| 104 | outlet flange/fitting |
| 105 | longitudinal beam |
| 106 | transverse beam |
| 107 | reservoir floor |
| 108 | fork lift channel |
| 109 | vent |
| 110 | access opening/manway |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A fluids management apparatus for managing multiple, different fluids on an oil and gas well drilling platform, comprising:

a) a structural, transportable frame that has upper and lower end portions, a plurality of side walls, a plurality of corners, a base, and an upper panel;

b) a reservoir section on the frame having a plurality of storage reservoirs for holding multiple, separate fluids, one separate fluid in each reservoir;

c) a plurality of flow outlets for discharging a selected fluid from a selected reservoir;

d) a docking station on the frame above the reservoir section, each station configured to receive a tank having a fluid holding interior that connects to a selected reservoir, the docking station having multiple spaced apart feet;

e) piping that enables a selected of the tanks to transfer its contents to a selected of the storage reservoirs;

f) each side wall having an outer surface with multiple spaced apart vertical beams and multiple spaced apart horizontal beams connected to said outer surface, each vertical beam having a web, each horizontal beam connecting to a said vertical beam at said web;

g) each storage reservoir having a side that is a part of a said side wall, said plurality of storage reservoirs separated by a plurality of transverse sides, and an internal longitudinal wall;

h) a reservoir panel that extends a partial distance but not completely across a said storage reservoir;

i) a plurality of lifting eyes attached to the frame, at least a pair of said horizontal beams attaching to each said lifting eye;

j) each vertical beam having a said web attached to a said side wall and a flange attached to said web;

k) a load transfer interface that enables load transfer from the docking station to the frame, said interface including a load transfer plate at a top of each vertical beam, said load transfer plate attached to both a said web and a said flange of a said vertical beam; and l) wherein each foot of the docking station rests upon a said load transfer plate.

2. The fluids management apparatus of claim 1 wherein each reservoir beam attaches to a transverse wall.

3. The fluids management apparatus of claim 1 wherein there are between 4 and 6 storage reservoirs.

4. The fluids management apparatus of claim 1 wherein at least one of the storage reservoirs is smaller than another of the storage reservoirs.

5. The fluids management apparatus of claim 1 wherein one of the storage reservoirs extends from one side wall to another side wall.

6. The fluids management apparatus of claim 1 wherein the frame has multiple lifting eyes that attach to a side wall and said upper panel.

7. The fluids management apparatus of claim 6 wherein each lifting eye is connected to a horizontal beam.

8. The fluids management apparatus of claim 7 wherein each lifting eye is in the form of a plate that forms an acute angle with a side wall.

9. The fluids management apparatus of claim 8 wherein each lifting eye is spaced in between a corner and another lifting eye.

10. The fluids management apparatus of claim 1 wherein each tank support is mounted upon a said vertical beam.

11. The fluids management apparatus of claim 10 wherein said plate forming a load transfer location for a said tank.

12. A fluids management apparatus for managing multiple, different fluids in an oil and gas well drilling platform, comprising:

a) a structural, transportable frame;

b) a lower tank section on the frame having a plurality of interval storage tanks for holding multiple, separate fluids, said interval storage tanks surrounded by external side walls and end walls;

c) a plurality of flow outlets for discharging a selected fluid from a selected interval storage tank;

d) an upper tank section that comprises one or more transportable, crane liftable tanks;

e) a docking station on the frame above the lower tank section that is configured to receive the upper tank section, the docking station having multiple spaced apart feet, the upper tank section having a plurality of supply tanks;

f) piping that enables a selected of the supply tanks to transfer its contents to a selected of the interval storage tanks;

g) a plurality of horizontal stiffeners and a plurality of vertical beams each having a web, said stiffeners and beams mounted on said lower tank section, the horizontal stiffeners and vertical beams intersecting wherein a horizontal stiffner connects the web of a vertical beam;

h) the docking station feet defining load transfer plates on said vertical beams that define supports for receipt of the docking station;

i) each vertical beam having a said web attached to a side wall and a flange attached to a said web;

j) a load transfer interface that enables load transfer from the docking station to the frame, said interface including a load transfer plate at a top of each vertical beam, said load transfer plate attached to both said web and said flange; and k) wherein each foot of the docking station rests upon a said load transfer plate.

13. The fluids management apparatus of claim 12 wherein there are at least three interval storage tanks.

14. The fluids management apparatus of claim 12 wherein there are between 4 and 6 interval storage tanks.

15. The fluids management apparatus of claim 12 wherein at least one of the supply tanks is smaller than one of the interval storage tanks.

16. The fluids management apparatus of claim 12 wherein all of the supply tanks are smaller than each interval storage tank.

17. The fluids management apparatus of claim 12 wherein all of the flow outlets are positioned on the same side of the frame.

18. The fluids management apparatus of claim 12 wherein all of the flow outlets are positioned side-by-side and next to each other.

19. The fluids management apparatus of claim 12 wherein each supply tank has a supply tank outlet and the piping includes a plurality of flow lines, each connectable to a supply tank outlet.

20. The fluids management apparatus of claim 19 wherein each interval storage tank has a flow inlet and the piping includes multiple flow lines that enable flow to be directed to a selected interval storage tank from a selected supply tank.

21. A fluids management apparatus for managing multiple, different fluids in an oil and gas well drilling platform, comprising:

a) a structural, transportable frame having side walls, end walls, a bottom wall and an upper panel;

b) a lower reservoir section on the frame having a plurality of interval storage reservoirs for holding multiple, separate fluids;

c) a plurality of flow outlets for discharging a selected fluid from a selected interval storage reservoir;

d) a docking station on the frame above the lower reservoir section, said docking station having a plurality of feet and configured to receive one or more fluid holding vessels;

e) a reinforcement system for multiple of said side walls that includes intersecting pluralities of horizontal beams and vertical beams, each said vertical beam having a web attached to a said side wall and a flange connected to said web and an upper fitting that provides an attachment for and load transfer from a said fluid holding vessel;

f) each fitting connected to a top of a said vertical beam, said fitting attached to both said web and said flange of the said vertical beam; and g) wherein a said docking station foot rests upon a said upper fitting.

22. The apparatus of claim 21 further comprising an upper frame that holds multiple of said fluid holding vessels.

23. The apparatus of claim 22 wherein said upper frame has legs, each leg resting upon a said fitting.

24. The apparatus of claim 22 wherein the upper frame has one or more doors that can be opened and closed.

25. The apparatus of claim 1 wherein one of the storage reservoirs is a larger reservoir that extends to opposing sides of the internal longitudinal wall and further comprising an opening in the internal longitudinal wall that is in communication with the larger reservoir.

26. The apparatus of claim 23 wherein the upper frame has multiple upper angled plates that each form an obtuse angle with the bottom of a fluid holding vessel.

* * * * *